US010920723B2

(12) United States Patent
Hanby et al.

(10) Patent No.: US 10,920,723 B2
(45) Date of Patent: Feb. 16, 2021

(54) LIQUID AND VAPOR SEPARATOR

(71) Applicant: Walbro LLC, Tucson, AZ (US)

(72) Inventors: Jeffrey D. Hanby, Cass City, MI (US); Kevin L. Israelson, Cass City, MI (US); Elton J. Fisch, Caro, MI (US)

(73) Assignee: Walbro LLC, Tucson, AZ (US)

( * ) Notice: Subject to any disclaimer, the term of this patent is extended or adjusted under 35 U.S.C. 154(b) by 148 days.

(21) Appl. No.: 16/309,630

(22) PCT Filed: Jun. 15, 2017

(86) PCT No.: PCT/US2017/037645

§ 371 (c)(1),
(2) Date: Dec. 13, 2018

(87) PCT Pub. No.: WO2017/218754

PCT Pub. Date: Dec. 21, 2017

(65) Prior Publication Data

US 2019/0178212 A1 Jun. 13, 2019

Related U.S. Application Data

(60) Provisional application No. 62/351,041, filed on Jun. 16, 2016.

(51) Int. Cl.

| | |
|---|---|
| ***F02M 37/24*** | (2019.01) |
| ***F02M 37/20*** | (2006.01) |
| ***F02M 37/04*** | (2006.01) |
| ***F02M 37/46*** | (2019.01) |

(52) U.S. Cl.

CPC ..... *F02M 37/24* (2019.01); *F02M 37/04* (2013.01); *F02M 37/20* (2013.01); *F02M 37/46* (2019.01)

(58) Field of Classification Search

CPC ..... F02M 37/46; F02M 37/24; F02M 37/04; F02M 37/20

See application file for complete search history.

(56) References Cited

U.S. PATENT DOCUMENTS 5,103,793 A * 4/1992 Riese ..... F02M 37/08 123/516
6,422,207 B1 * 7/2002 Kolb ..... F02M 31/20 123/457

(Continued)

FOREIGN PATENT DOCUMENTS

CN 101111673 A 1/2008
CN 102900577 A 1/2013

(Continued)

OTHER PUBLICATIONS

Written Opinion & International Search Report for PCT/US2017/037645 dated Aug. 31, 2017, 13 pages.

(Continued)

*Primary Examiner* — Sizo B Vilakazi

(74) *Attorney, Agent, or Firm* — Reising Ethington P.C.

(57) ABSTRACT

In at least some implementations, a liquid and vapor separator includes a body and a cover, a fuel inlet, a fuel outlet and a vent passage. A fuel pump has an inlet in communication with the interior volume and an outlet in communication with the fuel outlet. A fuel pressure regulator has an inlet in communication with the fuel pump outlet, an outlet in communication with the interior volume and a valve between the fuel pressure regulator inlet and the fuel pressure regulator outlet. The fuel pressure regulator is carried by the cover and the cover defines at least part of a fuel passage between the fuel pump outlet and the fuel outlet. An inlet valve is received within the interior volume and associated with the fuel inlet. A wall at least partially separates the area of the fuel pump from the area of the inlet valve.

16 Claims, 10 Drawing Sheets

(56) References Cited

U.S. PATENT DOCUMENTS

| | | | | |
|---|---|---|---|---|
| 6,857,419 | B1 * | 2/2005 | Harvey | B01D 53/002 123/41.31 |
| 7,013,878 | B1 * | 3/2006 | Cotton | F02M 37/20 123/41.31 |
| 7,431,021 | B1 * | 10/2008 | Achor | F02M 37/0023 123/520 |
| 7,677,225 | B2 | 3/2010 | Radue et al. | |
| 8,857,414 | B2 | 10/2014 | Takata | |
| 2002/0174894 | A1 * | 11/2002 | Kolb | F02M 37/20 137/202 |
| 2007/0101974 | A1 * | 5/2007 | Achor | F02M 37/20 123/516 |
| 2009/0071448 | A1 * | 3/2009 | Smith | F02M 37/20 123/516 |
| 2009/0194074 | A1 * | 8/2009 | Radue | F02M 37/007 123/509 |
| 2014/0049057 | A1 * | 2/2014 | Brandt | B65D 45/345 292/256.69 |

FOREIGN PATENT DOCUMENTS

| | | | |
|---|---|---|---|
| WO | WO2005100773 | A1 | 10/2005 |
| WO | WO2007047276 | A2 | 4/2007 |

OTHER PUBLICATIONS

CN Office Action for CN Application No. 201780037152.0 dated Jun. 3, 2020 (17 pages).

* cited by examiner

LIQUID AND VAPOR SEPARATOR

REFERENCE TO RELATED APPLICATIONS

This application claims the benefit of U.S. Provisional Application Ser. No. 62/351,041 filed on Jun. 16, 2016, the entire contents of which are incorporated herein by reference.

TECHNICAL FIELD

The present disclosure relates generally to a liquid and vapor separator such as may be used in a fuel system.

BACKGROUND

Vapor separators are typically used to separate fuel vapor from liquid fuel in a fuel system for an internal combustion engine. A conventional vapor separator is usually connected with inlet and outlet fuel lines between a fuel tank and an engine. The vapor separator typically includes a fuel pump that receives liquid fuel from within the separator and pressurizes it for downstream delivery through fittings and hoses to a fuel rail in fluid communication with the engine. A fuel pressure regulator is typically carried by a downstream end of the fuel rail and returns excess fuel not injected into the engine from the fuel rail to the vapor separator through fittings and hoses. Further, the separator may include a valve to control the incoming fuel flow, a vent valve through which vapor may be vented from the separator and possibly other components making manufacture and assembly of the vapor separator more complicated and costly.

SUMMARY

In at least some implementations, a liquid and vapor separator includes a body and a cover coupled to the body by one or more connection features to define an interior volume between the cover and body. A fuel inlet is provided through which liquid fuel is admitted into the interior volume, a fuel outlet is provided through which fuel exits the separator, and a vent passage is provided through which gaseous matter is vented from the interior volume. A fuel pump is received within the interior volume, and has an inlet in communication with the interior volume and an outlet in communication with the fuel outlet. A fuel pressure regulator has an inlet in communication with the fuel pump outlet, an outlet in communication with the interior volume and a valve between the fuel pressure regulator inlet and the fuel pressure regulator outlet to permit fluid flow out of the outlet when the pressure of fuel on the valve is above a threshold pressure. The fuel pressure regulator is carried by the cover and the cover defines at least part of a fuel passage between the fuel pump outlet and the fuel outlet. An inlet valve is received within the interior volume and associated with the fuel inlet to at least in part control the admission of fuel into the interior chamber. A vent valve is associated with the vent passage to at least in part control fluid flow through the vent passage. And a wall at least partially separates the area of the interior volume in which the fuel pump is received from the area of the interior volume in which the inlet valve is received. Instead of or in addition to separating the fuel pump area from the inlet valve area, the wall may maintain an assembled position of the fuel pressure regulator, for example, by opposing movement of the regulator in a direction in which the regulator may be removed from the cover.

In at least some implementations, a liquid and vapor separator has a cover and a body that define an interior volume in which fluid is received. A fuel pressure regulator is received within the interior volume, and is carried by a bracket that is connected to the cover. A vent valve is trapped between the bracket and the cover.

In at least some implementations, a liquid and vapor separator has a cover and a body that define an interior volume and are coupled together by at least one strap having hooks that engage one or both of the cover and the body. The strap overlaps part of the body and part of the cover and the strap is trapped between opposed tabs on the cover and the body.

BRIEF DESCRIPTION OF THE DRAWINGS

The following detailed description of preferred implementations and best mode will be set forth with regard to the accompanying drawings, in which.

DETAILED DESCRIPTION

Figure 1:
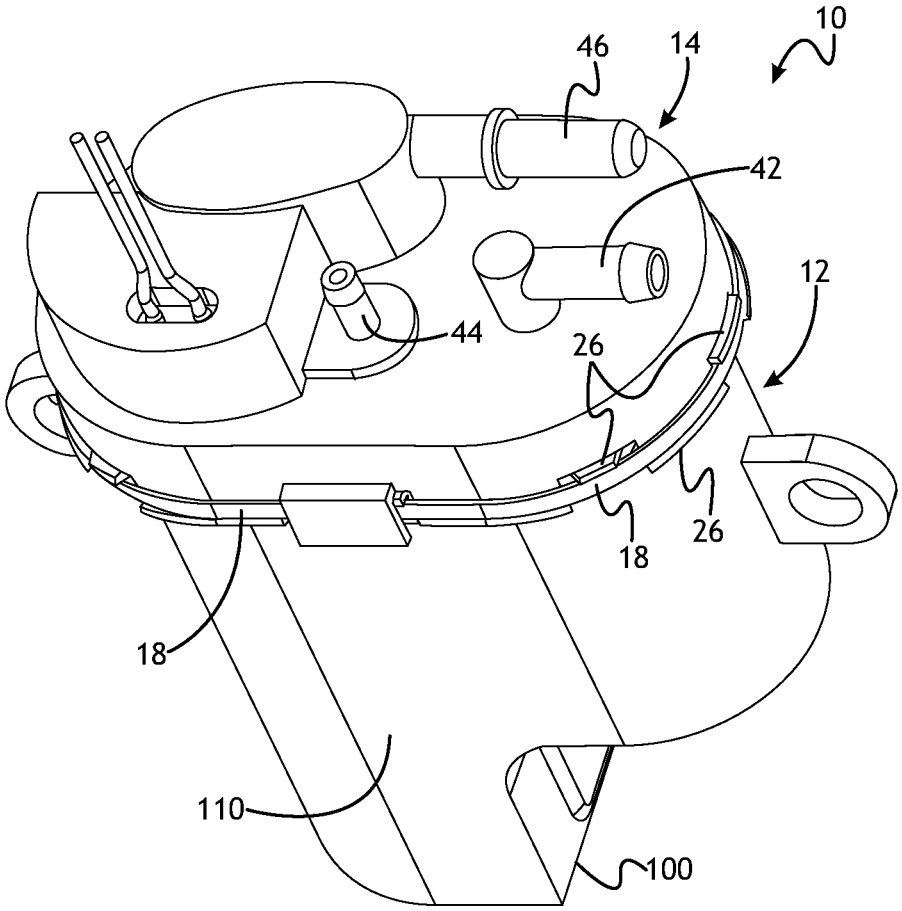
FIG. 1 is a perspective view of a fuel vapor separator.
Figure 12:
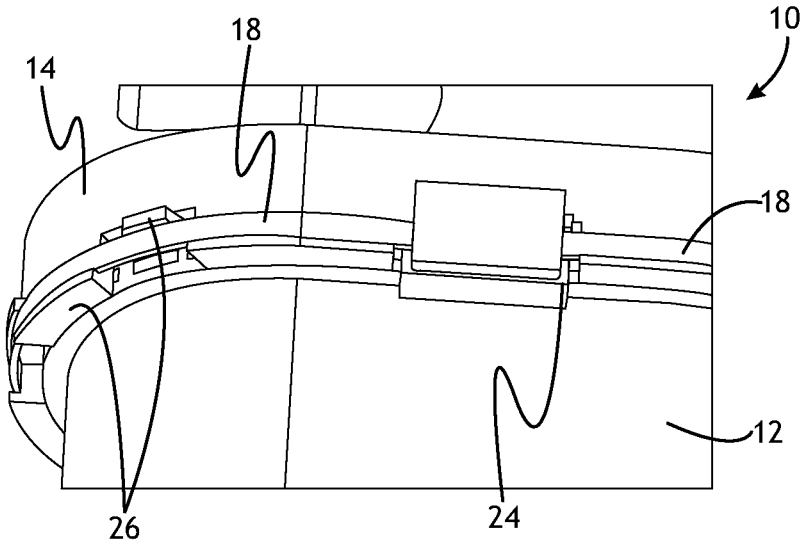
FIG. 12 is a fragmentary perspective view showing a connector on the cover and body of the separator.
Figure 13:
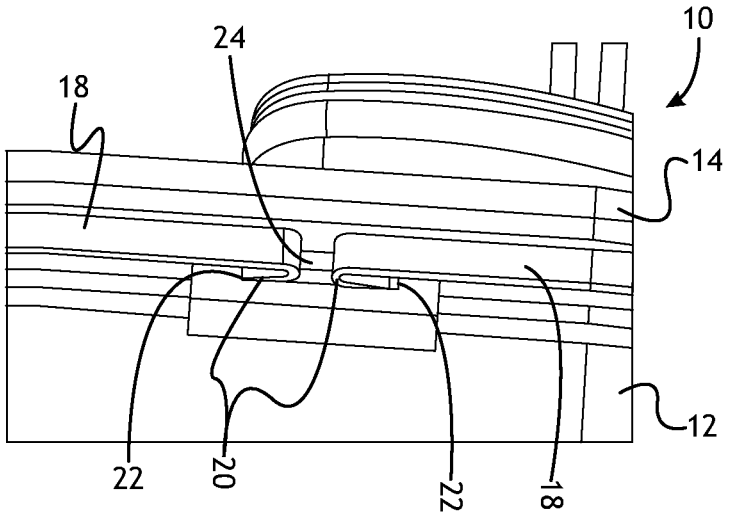
FIG. 13 is a fragmentary perspective view showing the connector on the body of the separator with the cover removed.
Figure 14:
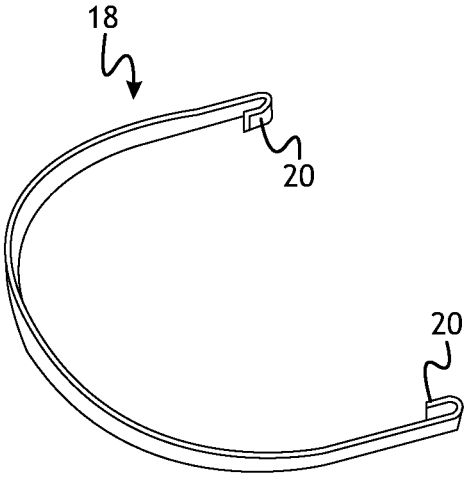
FIG. 14 is a perspective view of the connector, shown as a U-shaped metal strap with integral hooks at each end.

Referring in more detail to the drawings, FIG. 1 shows a liquid and vapor separator module 10 (hereinafter sometimes called a "fuel vapor separator") having a body 12 and a cover 14 coupled to the body to define an interior volume 16 in which fluid is received. The body 12 and cover 14 are coupled by a connector 18 that is received between and overlapped by opposed connection features extending from both the body and cover. See also FIGS. 12-14. The connector is shown as a steel strap 18 bent or otherwise formed to conform to the exterior shape of the body 12 and cover 14, and shown in this implementation as generally U-shaped. The strap 18 has integral fingers or hooks 20 at one or both ends (FIGS. 13 and 14) that engage a confronting surface 22 on either the cover 14 or the body 12 (FIG. 13 shows the hooks 20 engaging sidewalls of a pocket 24 formed in the body 12) or both the cover 14 and body 12. The hooks 20 may be defined by end portions of the straps 18 that are bent back toward the remainder of the strap. The main portion of the strap 18 may be received over the confronting surface 22 and extend beyond the confronting surface, and the hooks 20 may extend back toward and engage the confronting surface. More than one strap 18 may be used, and two are shown as being used in the illustrated embodiment. In the example shown, the connection features include multiple tabs 26 or outwardly extending projections on both the cover 14 and body 12 that are arranged to provide longitudinally opposing surfaces that trap the strap 18 between them (i.e. between oppositely facing surfaces to limit or prevent movement of the strap 18 relative to the surfaces).

Figure 2:
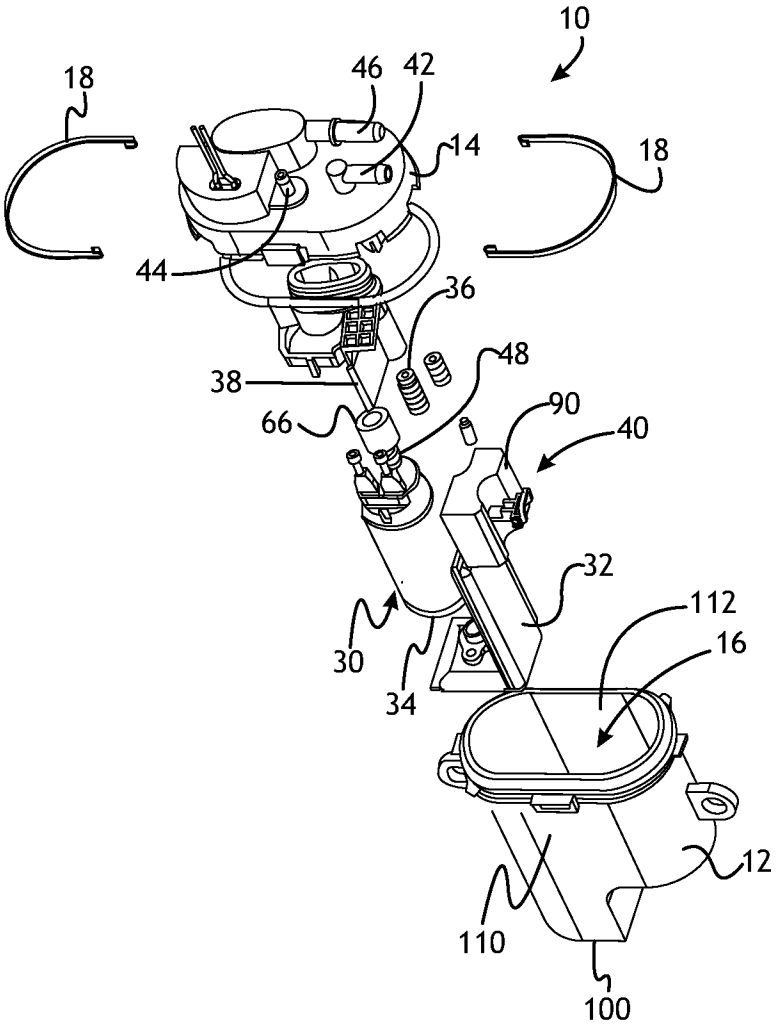
FIG. 2 is an exploded view of the fuel vapor separator.
Figure 8:
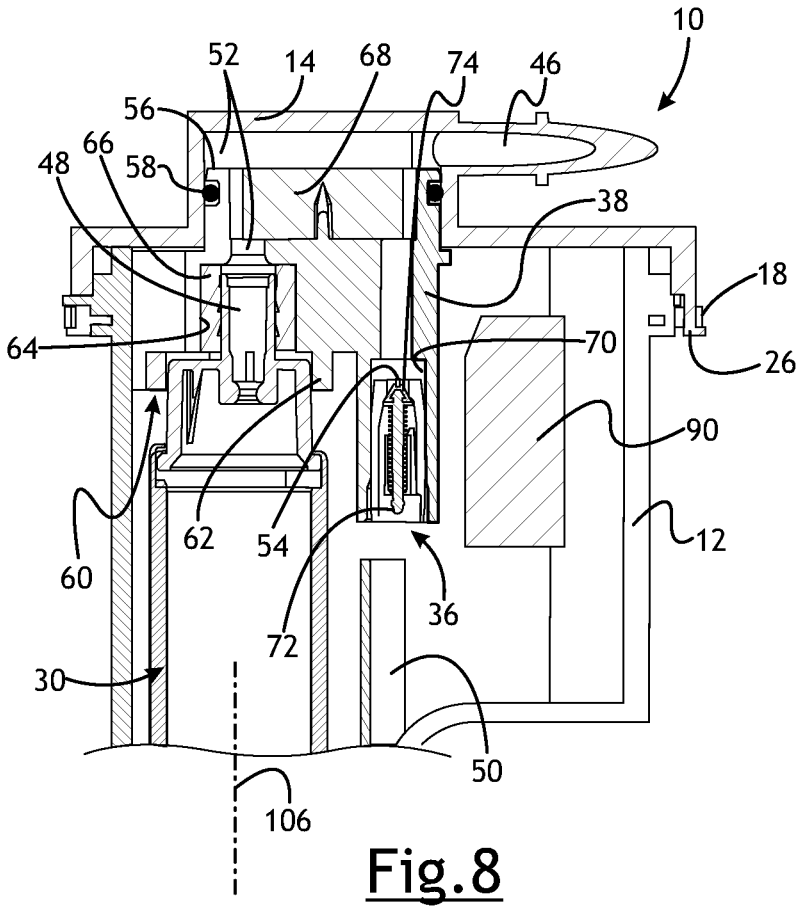
FIG. 8 is a side sectional view showing the fuel pump and fuel pressure regulator.
Figure 11:
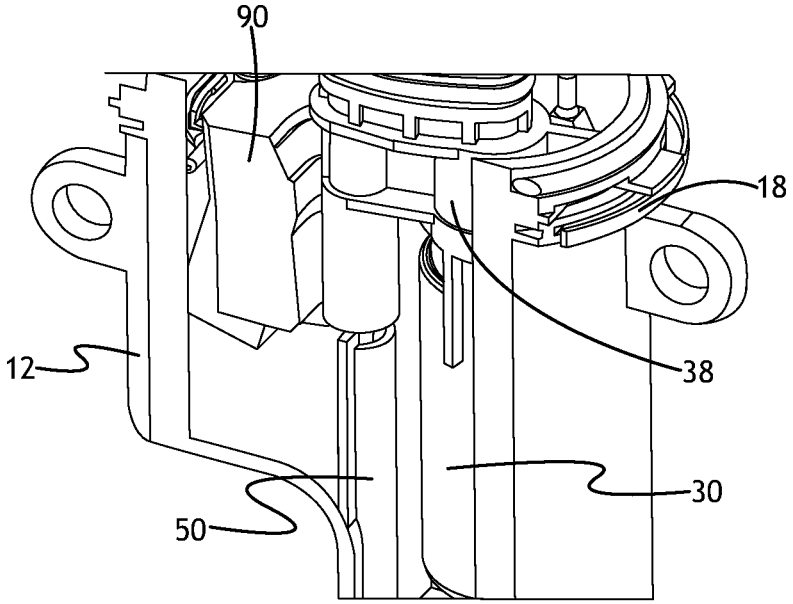
FIG. 11 is a perspective fragmentary sectional view of the body of the separator and the bracket and float.

As shown in FIG. 2, the separator 10 may also include a fuel pump 30, fuel filter 32 for the inlet 34 of the pump 30, a fuel pressure regulator 36, a bracket 38 for the fuel pressure regulator 36 and the fuel pump 30, and a float actuated inlet valve 40. The cover 14 is shown to include an inlet 42 into which fuel is received from a first, generally low pressure fuel pump (sometimes called a "lift pump" that moves fuel from a fuel tank to the module), a vent passage or vapor outlet 44 through which vapor may exit the interior volume 16 and a fuel outlet 46. The fuel pump 30 may be an electrically driven and relatively high pressure fuel pump that discharges fuel under pressure through the fuel outlet 46 for delivery to an engine. The pressure of discharged fuel is controlled at least in part by the fuel pressure regulator 36 which is in communication with the outlet 48 of the fuel pump 30, as best shown in FIG. 8. When the fuel is above a threshold pressure, the pressure regulator valve 36 opens to bypass fuel into the interior volume 16 of the separator. An internal web or wall 50 formed as part of or otherwise carried by the body 12 may direct the bypassed fuel away from the fuel pump inlet 34 and into the general volume 16 of the body 12 as shown in FIGS. 8 and 11. The electrical power to the pump 30 may also or instead be varied (e.g. pulse width modulation) to control, at least in part, the pump output.

In at least some implementations, the bracket 38 is carried by the cover 14, may help locate and be coupled to the fuel pump 30 at or near the fuel pump outlet 48, may carry the fuel pressure regulator 36, and may define all or at least part of a fuel passage(s) 52 between the fuel pump outlet 48 and an inlet 54 of the pressure regulator 36. In the implementation shown, the bracket 38 includes a first end 56 coupled to the cover 14 and including part of the fuel passage 52 arranged to communicate with the fuel outlet 46 of the cover 14. One or more seals 58 may be carried by the cover 14 and/or the bracket 38 to provide a fluid tight seal between them. The bracket 38 may also include a fuel pump retaining portion 60. The fuel pump retaining portion 60 may include one or more retaining features 62 adapted to engage a housing of the fuel pump 30 to at least in part retain the position of the fuel pump relative to the bracket 38 and the module 10 generally.

The fuel pump receiving portion 60 may also include a cavity 64 in the bracket 38 into which a portion of the fuel pump 30 extends, such as an outlet fitting of the fuel pump, so that fuel discharged from the fuel pump enters the cavity 64 and/or a passage communicating with the cavity. Fuel is then routed through the bracket 38 and then to the outlet 46 of the cover 14. As shown in FIGS. 2 and 8, an outlet bushing 66 may be provided between the pump 30 and the bracket 38 to, for example, provide a fluid seal between them, retain the position of the pump and/or to damp vibrations. The fuel passage 52 leads from the cavity 64 to both the outlet 46 of the cover 14, and to a passage or cavity communicated with the fuel pressure regulator inlet 54. In the example shown, bracket 38 has an opening 68 that communicates with the cavity 64 and with the fuel outlet 46, and a seal 58 is provided between the bracket 38 and cover 14 to prevent or inhibit liquid fuel leaking back into the interior volume 16 of the separator 10. Also, in the example shown, the fuel pressure regulator 36 is received at least partially within a second cavity 70 in the bracket 38 and is retained and carried by the bracket. Outlet fuel is routed by the bracket 38 in part to the fuel pressure regulator 36 which may include a valve element 72 biased against a valve seat 74 to remain closed until acted upon by fuel at a pressure above a threshold pressure. Then, the valve element 72 is displaced from the valve seat 74 and fuel flows through the valve seat. This fuel is returned to the interior of the module 10 and is not discharged from the fuel outlet 46 of the module, and the fuel pressure discharged from the module is thus maintained at or below the threshold pressure.

Figure 3:
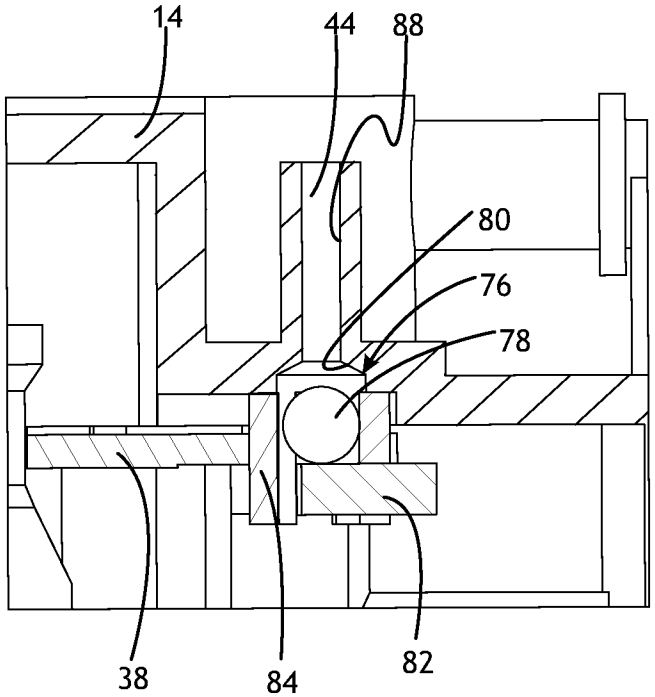
FIG. 3 is a fragmentary sectional view showing a vent valve, fuel pressure regulator bracket and cover of the fuel vapor separator.
Figure 4:
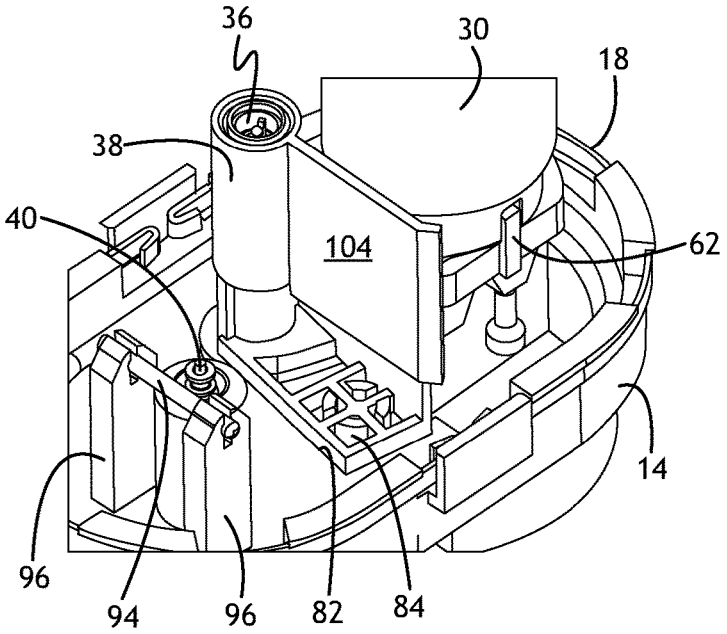
FIG. 4 is a fragmentary perspective view of a portion of the fuel vapor separator showing an inside of the cover, the fuel pressure regulator bracket and a portion of a fuel pump.

FIGS. 3 and 4 show a vapor vent valve 76 that is carried between the cover 14 and the bracket 38. The vent valve 76 may include or be defined by a ball 78 that engages a seat 80 when acted upon by liquid fuel (e.g. the ball 78 is buoyant) to selectively close the vapor outlet 44 when fuel is present at the ball, to inhibit or prevent fuel from leaking out of the vapor outlet. By simply trapping the ball 78 between the bracket 38 and the cover 14, separate retaining structures are not needed and the assembly of the module 10 is simpler and less expensive. Instead of being buoyant, the ball 78 may sink in liquid fuel and be used to close the vent 44 when the module 10 is inclined beyond a limit or inverted. This inhibits or prevents fuel from leaking from the module 10 when the module is tipped significantly or inverted. In the example shown, the bracket 38 includes a valve retaining body 82 that is spaced from the fuel pump receiving portion 60 and cavity 70 in which the fuel pressure regulator 36 is retained. The valve retaining body 82 may include snap-fit or other connection features adapted to mate with or overlie the corresponding valve receiving portion 84 of the cover 14, which is shown as a generally cylindrical cavity or bore in the cover. To simplify construction and assembly of the components, the valve retaining body 82 may be integral with the remainder of the bracket 38, that is, formed in the same piece of material and at the same time as the remainder of the bracket. The cover 14 may include a counterbore that defines the valve seat 80 and the vent passage 44 may be defined downstream of the valve seat by a smaller diameter bore 88 extending through the cover 14. The ball 78 may be larger than the bore 88 and, when engaged with the valve seat 80, prevent or significantly inhibit fluid flow through the valve seat to the bore 88. Of course, other valve types may be used and need not be retained by the bracket, as desired.

Figure 5:
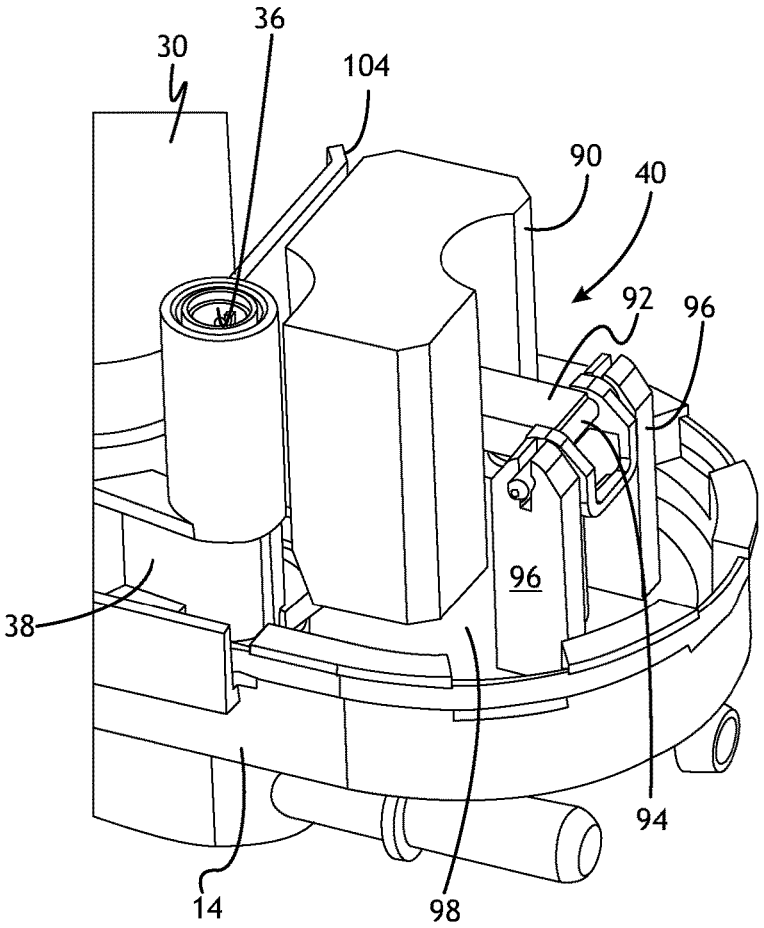
FIG. 5 is a fragmentary perspective view of a portion of the fuel vapor separator showing a float valve, the cover and bracket.
Figure 6:
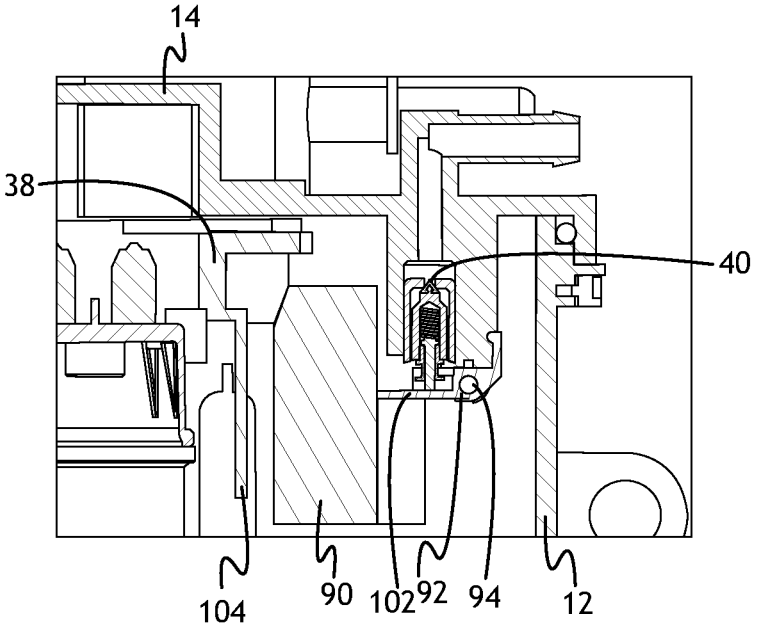
FIG. 6 is a fragmentary side sectional view showing the float valve.
Figure 7:
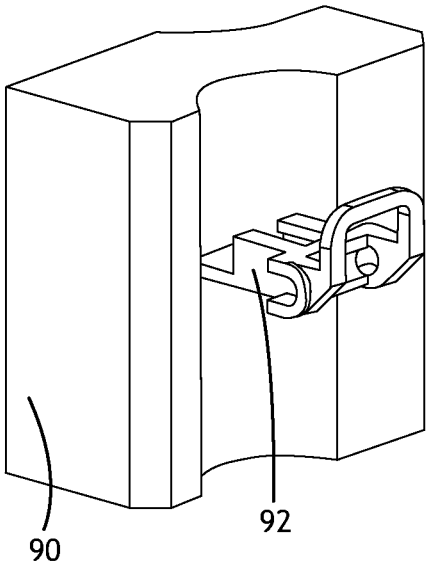
FIG. 7 is a perspective view of the float.

FIGS. 5, 6 and 7 illustrate the inlet valve 40 for the separator module 10. The inlet valve 40 permits fluid flow at the inlet 42 to enter the interior volume 16 when the valve is open. The valve 40 is coupled to and driven by an actuator. In the example shown, the actuator is a float 90 that is buoyant in liquid. The float 90 is coupled to the valve 40 to move the valve as the float moves in response to a change in liquid level in the separator. In at least some implementations, the inlet valve 40 is connected to a hinge 92, and the hinge is coupled to the float 90 and to a pivot 94 about which the float pivots. The hinge 92 may be carried by the cover 14, such as by one or more than one depending finger 96 extending from an interior surface 98 of the cover 14 toward a bottom wall 100 (FIGS. 1 and 2) of the separator body 12 such that the pivot point for the hinge 92 and/or float 90 is spaced from the interior surface 98 of the cover 14. In the example shown, the pivot is defined by a pin 94 that is coupled to two fingers 96 and the hinge 92 is coupled to the pivot pin 94 between the two fingers. The inlet valve 40, in turn, is coupled to the hinge 92 at a location spaced from the pivot pin 102, and between the pivot pin and the location at which the hinge is coupled to the float 90. When the level of liquid fuel in the separator 10 is below a threshold, the float 90 is lowered to a point at which the inlet valve 40 is opened. When the float 90 is raised above that point by liquid fuel acting on the float, the inlet valve 40 is closed and fluid flow through the separator inlet 42 is prevented.

Figure 9:
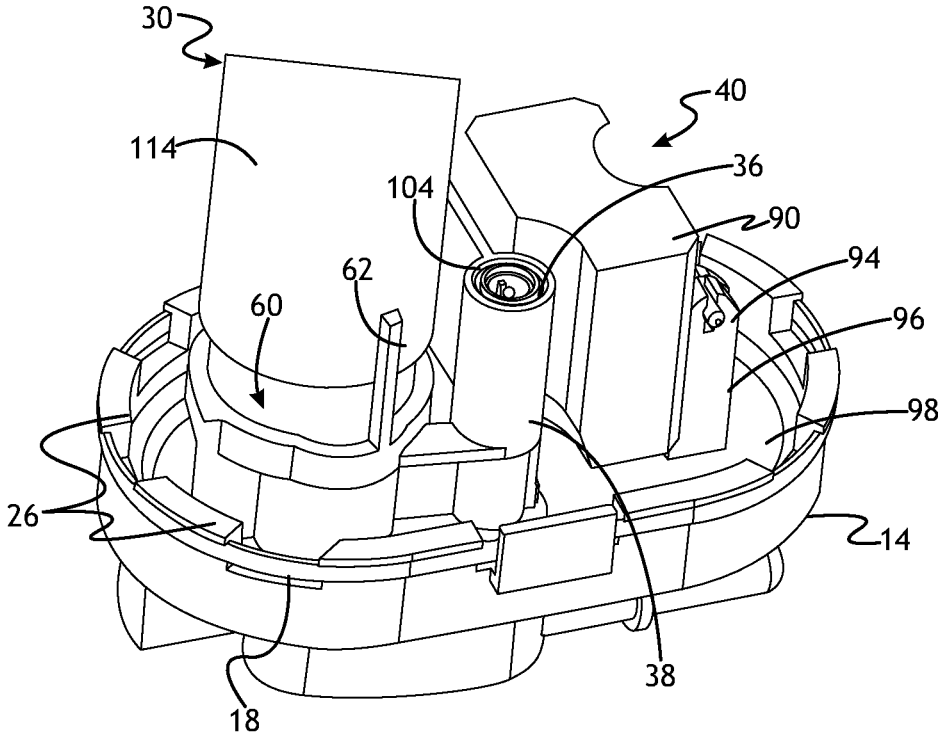
FIG. 9 is an enlarged perspective view of the bracket, fuel pump, float and cover.
Figure 10:
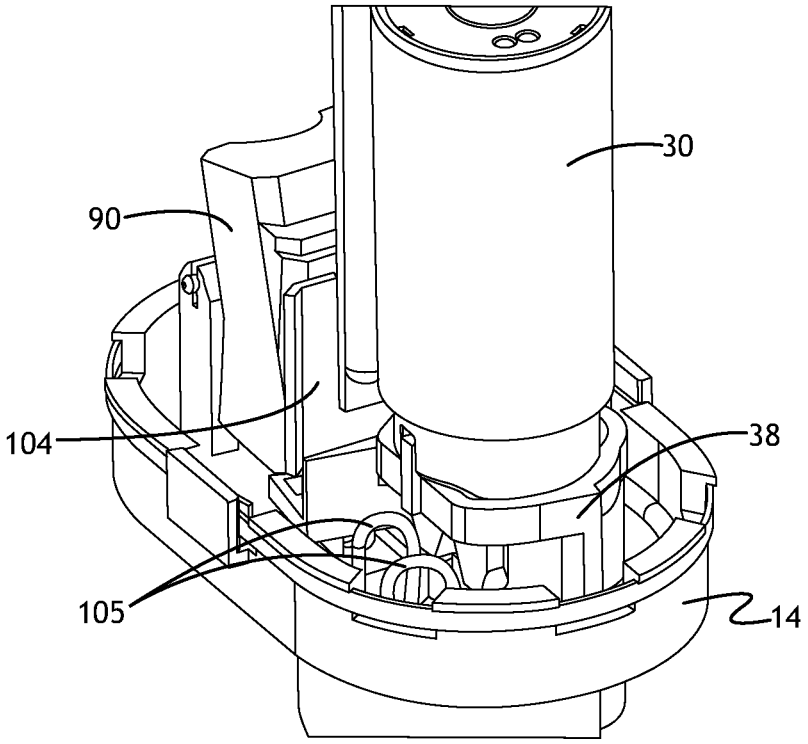
FIG. 10 is a perspective view of the cover, fuel pump and bracket.

A wall 104 of the bracket 38 keeps the float 90 separate from the fuel pump 30, the pump filter 32 and electric wires 105 that are routed to the fuel pump, as shown in FIGS. 5, 9 and 10. The wall 104 inhibits or prevents such components from interfering with the movement of the float 90 in response to changing liquid level in the interior volume 16. The wall 104 may extend along any axial length of the fuel pump 30 (relative to a longitudinal axis 106 (FIG. 8) of the fuel pump), or longitudinal height of the separator 10, and have a desired width transverse to the axial or longitudinal length to provide a barrier of a desired size between the portion of the separator in which the fuel pump 30 is received and the portion in which the float 90 is received. So as to not take up unnecessary volume in the separator, the wall 104 may be made relatively thin, such as between about 2 and 10 mm. To reduce vapor generation, the wall 104 may also reduce liquid fuel slosh in the separator interior volume 16 by providing a barrier that interrupts liquid movement in the separator. The wall, when part of the bracket 38, like the pump receiving portion 60 and valve retaining body 82 may be formed in one piece and at the same time as the remainder of the bracket such that the bracket is an integral, one-piece body that has portions serving the different functions and structural relationships discussed above. A wall to separate the other components from the area of the float, and/or to reduce fuel slosh may also or instead be provided as part of the cover 14 or the body 12, such as the web 50 noted above. As shown in FIG. 11, the wall and/or web 50 may be generally parallel to the pump axis 106, and extend laterally between opposed sidewalls 110, 112 (FIG. 2) or sidewall portions of the separator body 12. In other words, the wall 50 may be formed at the same time and from the same piece of material as the remainder of the separator body 12 or the wall may be an insert assembled into and carried by the separator body.

FIG. 9 also shows that the bracket 38 may engage a metal outer shell or casing 114 of the fuel pump 30. When the bracket 38 itself is formed of an electrically conductive material (e.g. metal or a conductive plastic, such as but not limited to plastics that are doped with or otherwise include carbon or metallic particles), the fuel pressure regulator 36 and the vent valve 76 may be electrically grounded through the bracket 38 and the fuel pump casing 114 as the fuel pump 30 is itself grounded in known manner.

FIGS. 15-21 illustrate another fuel vapor separator 120 that includes many of the same components as the fuel and vapor separator 10 shown in FIGS. 1-14. To facilitate description of the separator 120, for the components that are the same as or similar to components in separator 10 already described, the same reference numbers will be used and a complete description of such components may be omitted. Instead, the description below will primarily, but not solely, focus on the differences between the separators 10 and 120.

Figure 15:
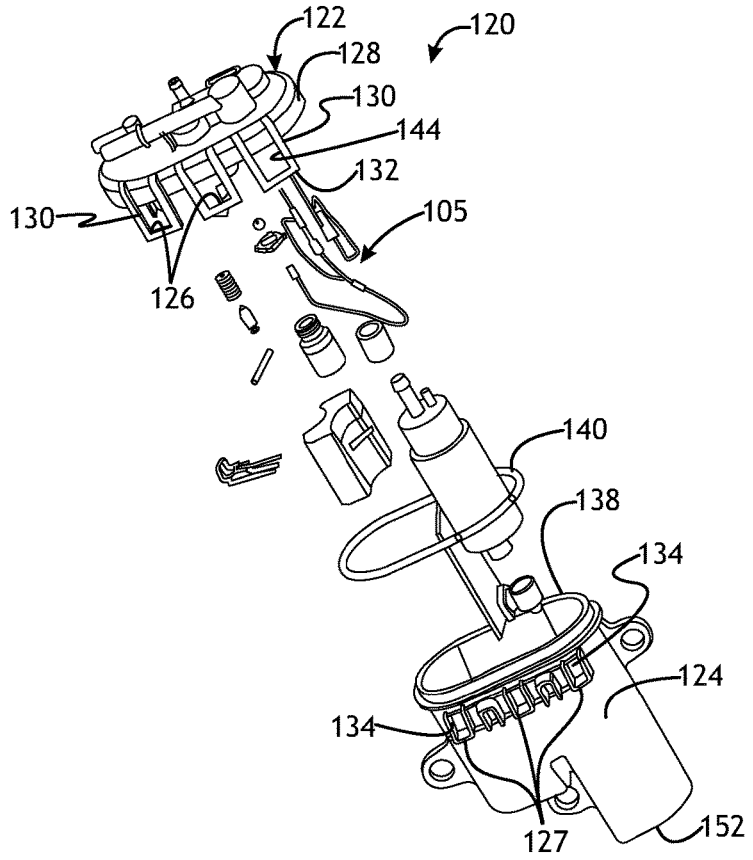
FIG. 15 is an exploded view of a fuel vapor separator.
Figure 16:
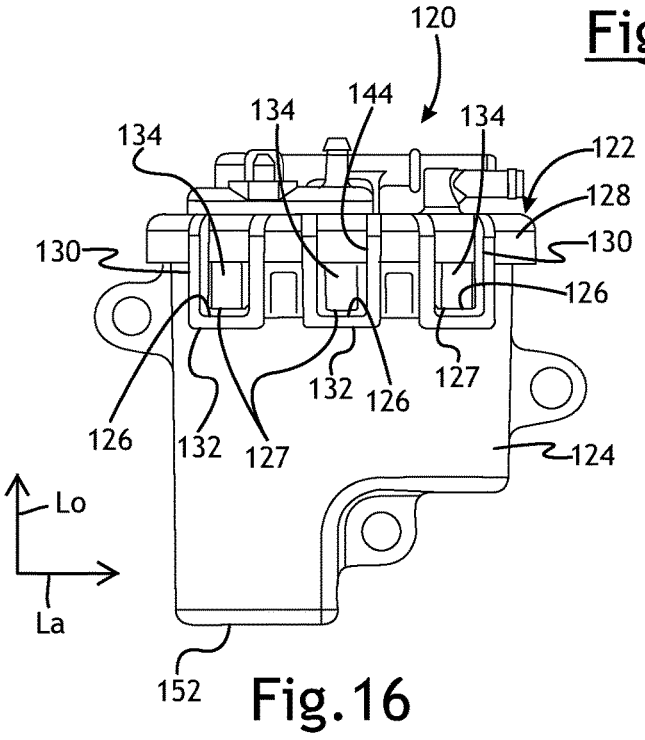
FIG. 16 is a front view of the fuel vapor separator of FIG. 15.
Figure 17:
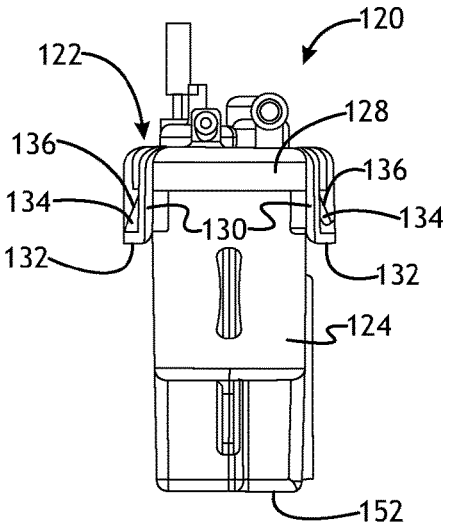
FIG. 17 is a side view of the fuel vapor separator of FIG. 15.

As best shown in FIGS. 15-17, a cover 122 of separator 120 is coupled to a body 124 by multiple connection features. The connection features including longitudinally facing stop surfaces 126, 127 of the cover and body, respectively, that are laterally overlapped in assembly to inhibit or prevent removal of the cover from the body. In this example, the longitudinal direction is shown by the arrow $L_o$ and the lateral direction by the arrow $L_a$ in FIG. 16. In the implementation shown, the cover 122 includes a main body 128 and flexible, resilient, cantilevered tabs 130 that extend away from the main body 128 to a free end 132, and the body 124 includes laterally outwardly extending projections 134 that each have a stop surface 127 that faces longitudinally away from the cover 122. Each projection 134 (or at least some of the projections) may include an inclined outer surface 136 (FIG. 17) that faces outwardly from the body 124 and extends from an end closer to the open, upper end 138 (FIG. 15) of the body 124 to a distal end adjacent to and/or including the stop surfaces 127.

Figure 18:
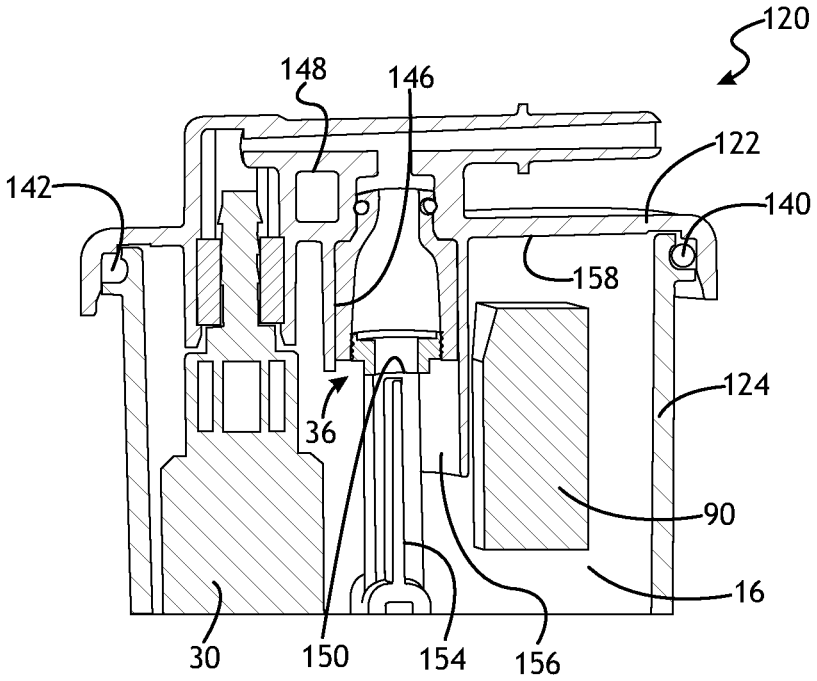
FIG. 18 is a fragmentary front sectional view showing part of the interior of the fuel vapor separator.

In assembly, after the internal components of the separator 120 are inserted into the body 124 and/or assembled to the cover 122, the cover is pressed onto the body in the longitudinal direction. Inner surfaces of the tabs 130 on the cover 122 engage the outer surfaces 136 of the projections 134 on the body 124 and the tabs are laterally outwardly flexed as they slide along the projections until the stop surface 126 of each tab 130 passes the stop surface 127 of the projection 134. When this occurs, the resilient nature of the material of the tabs 130 causes the tabs to return laterally inwardly toward their unflexed state so that the stop surfaces 126, 127 of the tabs 130 and projections 134 are laterally overlapped. So arranged, the cover 122 cannot be simply pulled off of the body 124 longitudinally because the stop surfaces 126, 127 will engage each other and prevent such movement of the cover relative to the body. In at least some implementations, the tabs 130 may be bent laterally outwardly so that they clear the stop surfaces 127 of the projections 134 to permit the cover 122 to be removed from the body 124 for servicing the separator 120, if desired. In some implementations, the longitudinal length of the tabs 130 and projections 134, which determines the relative location of the stop surfaces 126, 127, may be chosen to provide compression of an annular seal 140 located between the cover 122 and body 124, to ensure a fluid-tight seal between the cover and body. And/or the seal 140 may be laterally compressed between the cover and body, as generally shown in FIG. 18, wherein the width of a seal chamber 142 defined between the cover 122 and body 124 is less than the lateral width or diameter of the seal 140. Also, in at least some implementations, the tabs 130 include openings 144 having a width, perpendicular to both longitudinal and lateral directions, so that the tabs are generally U-shaped with the stop surface 126 defined by the bottom of the U. In the implementation shown, the width of the tabs 130 is greater than the width of the projections 134, and in assembly, at least some projections are received generally within an opening 144 of a corresponding tab 130. In this arrangement, no strap(s) is needed, although additional connection feature like a band or strap may be used, for example, around the tabs 130 to prevent unintended outward flexing or bending of the tabs after the cover 122 is installed on the body 124.

As also shown in FIG. 18, the fuel pressure regulator 36 (only the housing of which is shown) may be received at least partially within a cavity 146 formed in the cover 122, with a seal 148 between them. The cavity 146 may open longitudinally and face the bottom of the body 124 in assembly, although other orientations may be used. To retain the fuel pressure regulator 36 within the cavity 146, the body 124 may include a retaining surface 150 that engages the fuel pressure regulator 36 or is spaced therefrom but located close enough that the fuel pressure regulator cannot be removed from the cavity 146 when the cover 122 is assembled onto the body 124. The retaining surface 150 may extend laterally inwardly from a sidewall 151 of the body 124 and/or longitudinally upwardly from the bottom wall 152 of the body. The retaining surface 150 may be defined by a surface of a wall 154 or web formed in the body 124. The wall 154 or web may also provide other functions, such as reducing fuel slosh and/or separating a chamber in which the float 90 moves from a chamber including the fuel pump 30 and its filter 32 and wires.

Figure 19:
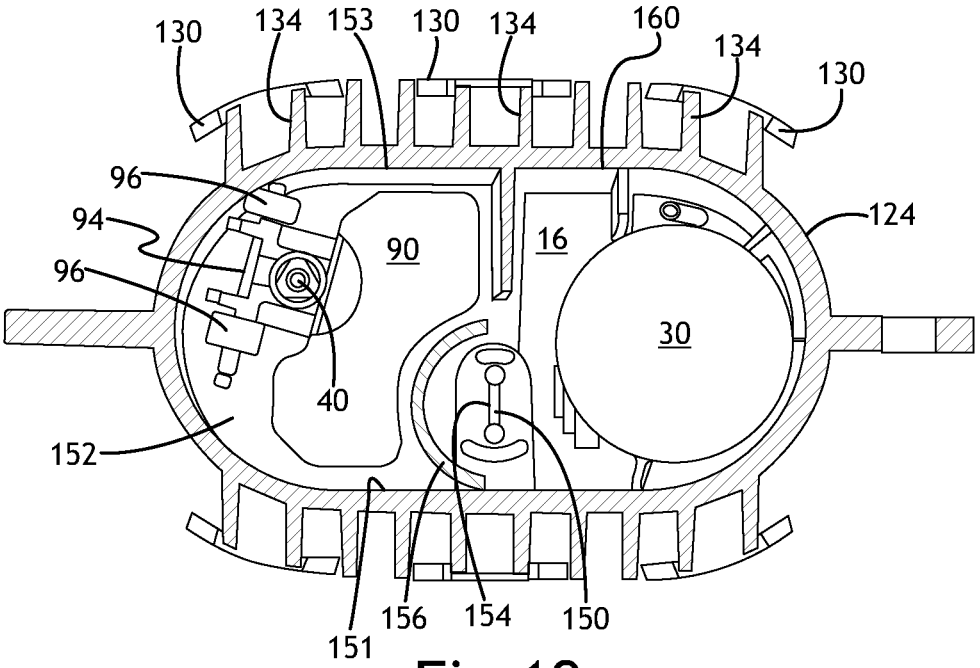
FIG. 19 is a fragmentary sectional view of the fuel vapor separator.
Figure 20:
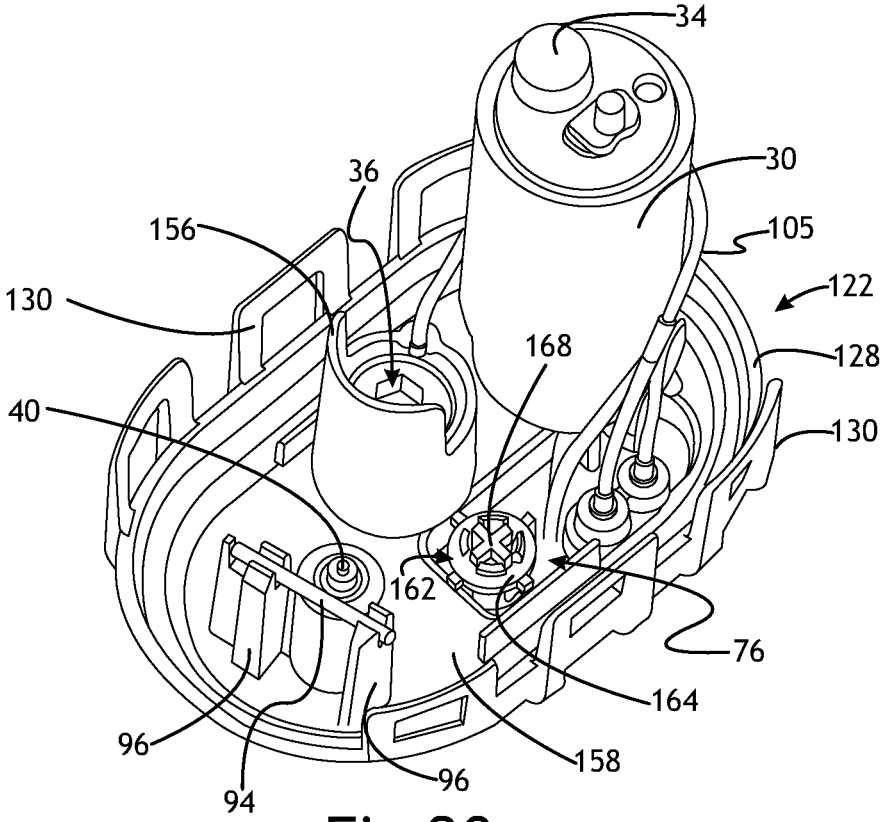
FIG. 20 is a bottom perspective view of a cover of the fuel vapor separator.

In the example shown in FIGS. 18-20, the cover 122 includes a longitudinally extending wall or flange 156 that depends or extends from an inner surface 158 of the cover 122. The flange 156 is generally curved or arcuate and is located between the retaining surface 150 and the float 90, and may serve to separate the float from the flow of fuel discharged from the fuel pressure regulator 36 and/or the fuel filter 32 and wires associated with the fuel pump 30. In this way, the flange 156 may separate the float chamber, or area within the interior volume 16 of the separator 120 in which the float 90 moves, from the area in the interior volume in which the fuel pressure regulator 36 and fuel pump 30 are received. As best shown in FIG. 19, the body 124 may include an inwardly and longitudinally extending wall 160 that is connected along one side to the body sidewall 153 and extends to a free end within the interior of the body 124. The wall 160 may also serve to divide the interior volume 16 into more than one chamber (which need not be entirely separate and can be in fluid communication with each other), for example, to reduce fuel slosh and/or to separate the area in which the float 90 moves from the area including the fuel pump 30 and any filter 32 and wires of the fuel pump. The wall 160 may have any desired longitudinal length, any desired lateral width and may be relative thin (dimension perpendicular to lateral and longitudinal directions) to avoid consuming or taking up too much interior volume 16 of the body 124. The wall 160 may be connected to the bottom wall 152 of the body 124, or spaced therefrom. The wall may be joined or separate from the web 154 with fuel able to flow within the interior volume 16 between the area of the float 90 and the area of the fuel pump 30.

Figure 21:
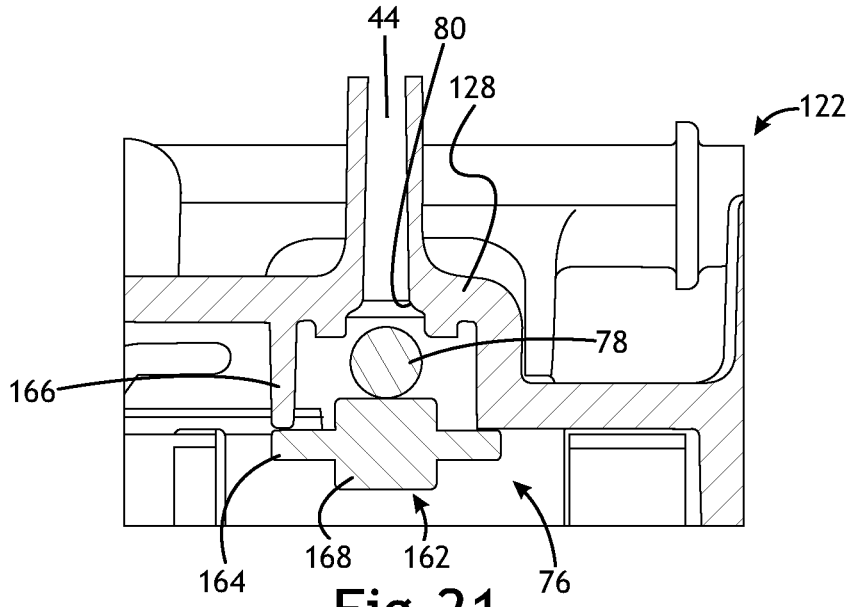
FIG. 21 is a fragmentary sectional view of a portion of the cover showing a vent valve.

As set forth with regard to the separator 10, the vent valve 76 in separator 120 may be carried by the cover 122 and operable to control fluid flow out of a vent passage 44 formed in the cover 122, as shown in FIGS. 20 and 21. The vent valve 76, as shown includes a valve element trapped between the cover 122 and a retainer 162 that is coupled to the cover. The vent element may be a ball 78 and the retainer 162 may be a body formed separately from the cover 122, and which is snap-fit or otherwise coupled to the cover without any separate fastener needed to maintain the parts coupled together. The retainer 162 may include a rim 164 received around a boss 166 protruding from the inner surface of the cover 122, and a central portion 168 that covers a portion of the boss 166 to retain the ball 78 while permitting fluid flow therethrough. The ball 78 could be buoyant in liquid fuel to close when acted upon by liquid fuel, or the ball could sink in the fuel and arranged to close the vent 44 if the separator 120 is inclined significantly or inverted to prevent liquid fuel from leaking from the inclined or inverted separator.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A liquid and vapor separator, comprising:

a body;

a cover coupled to the body by one or more connection features to define an interior volume between the cover and body;

a fuel inlet through which liquid fuel is admitted into the interior volume;

a fuel outlet through which fuel exits the separator;

a vent passage through which gaseous matter is vented from the interior volume;

a fuel pump received within the interior volume, the fuel pump having an inlet in communication with the interior volume and an outlet in communication with the fuel outlet;

a fuel pressure regulator having an inlet in communication with the fuel pump outlet, an outlet in communication with the interior volume and a valve between the fuel pressure regulator inlet and the fuel pressure regulator outlet to permit fluid flow out of the outlet when the pressure of fuel on the valve is above a threshold pressure, wherein the fuel pressure regulator is carried by the cover and wherein the cover defines at least part of a fuel passage between the fuel pump outlet and the fuel outlet;

an inlet valve received within the interior volume and associated with the fuel inlet to at least in part control the admission of fuel into the interior chamber;

a vent valve associated with the vent passage to at least in part control fluid flow through the vent passage;

a wall at least partially separating the area of the interior volume in which the fuel pump is received from the area of the interior volume in which the inlet valve is received; and a bracket connected to and carried by the cover, and wherein the fuel pressure regulator is carried by the bracket.

2. The separator of claim 1 wherein the wall is defined by the bracket.

3. The separator of claim 1 wherein the bracket defines part of a fuel passage between the fuel pump outlet and the fuel pressure regulator inlet.

4. The separator of claim 1 wherein the body includes a retaining surface that maintains an assembled position of the fuel pressure regulator.

5. The separator of claim 1 wherein the cover or the body includes a wall that extends into the interior volume and is located outboard of and adjacent to the fuel pressure regulator outlet to control at least in part the direction of fuel flow from the fuel pressure regulator outlet.

6. The separator of claim 5 wherein the wall is disposed between the outlet of the fuel pressure regulator and the fuel pump.

7. The separator of claim 5 wherein the wall is disposed between the outlet of the fuel pressure regulator and the inlet valve.

8. The separator of claim 1 wherein the inlet valve includes a float that is buoyant in liquid fuel within the interior volume, and wherein the float is carried by the cover.

9. The separator of claim 8 wherein the cover includes or carries a pivot and the float includes a hinge that is coupled to the pivot for movement of the float relative to the cover.

10. A liquid and vapor separator having a cover and a body that define an interior volume in which fluid is received, a fuel pressure regulator within the interior volume, a bracket that carries the fuel pressure regulator that is connected to the cover, and a vent valve trapped between the bracket and the cover.

11. The separator of claim 10 wherein the vent valve includes a ball that selectively engages a seat formed in the cover.

12. The separator of claim 10 wherein the bracket is formed from an electrically conductive material and where in the bracket engages both the fuel pressure regulator and another component that is electrically grounded so that fuel pressure regulator is electrically grounded through the bracket.

13. The separator of claim 10 which also includes a fuel pump having an outer casing of an electrically conductive material, the fuel pump being electrically grounded and the bracket being in contact with the casing.

14. A liquid and vapor separator having a cover and a body that define an interior volume and are coupled together by at least one strap having hooks, wherein the hooks engage one or both of the cover and the body, and wherein the strap overlaps part of the body and part of the cover, and the strap is trapped between opposed tabs on the cover and the body, wherein the opposed tabs extend outwardly from the cover and the body, and the opposed tabs provide longitudinally opposing surfaces between which the strap is trapped to limit longitudinal movement of the strap relative to the cover and the body.

15. The separator of claim 14 wherein at least one of the cover and the body includes a confronting surface and wherein the strap includes at least one hook that is engaged with the confronting surface.

16. The separator of claim 15 wherein the strap includes a main portion that is received over the confronting surface and extends beyond the confronting surface, and the at least one hook extends back toward and engages the confronting surface.

* * * * *